US006552665B1

(12) United States Patent
Miyamae et al.

(10) Patent No.: US 6,552,665 B1
(45) Date of Patent: Apr. 22, 2003

(54) TELEMETRY SYSTEM FOR BOREHOLE LOGGING TOOLS

(75) Inventors: Shohachi Miyamae, Machida (JP); Tetsuya Tanaka, Machida (JP); David Mathison, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/456,349

(22) Filed: Dec. 8, 1999

(51) Int. Cl.[7] ..... G01V 1/46
(52) U.S. Cl. ..... 340/854.9; 340/853.3
(58) Field of Search ..... 340/854.9, 855.3, 340/855.4, 855.6, 853.3; 370/325, 326, 314, 328

(56) References Cited

U.S. PATENT DOCUMENTS 4,901,289 A * 2/1990 Cretin et al. ..... 340/855.3
5,010,333 A * 4/1991 Gardner et al. ..... 340/854.1
5,062,084 A * 10/1991 Schoepf et al. ..... 340/853.9
5,331,318 A * 7/1994 Montgomery ..... 340/855.4
5,365,229 A * 11/1994 Gardner et al. ..... 340/855.4
5,602,541 A * 2/1997 Comeau et al. ..... 175/45
5,802,311 A * 9/1998 Wronski ..... 340/825
6,021,095 A * 2/2000 Tubel et al. ..... 166/166

FOREIGN PATENT DOCUMENTS

EP 0617196 * 9/1994
WO WO 96 23368 8/1996
WO WO 98 10540 3/1998

* cited by examiner

*Primary Examiner*—Michael Horabik
*Assistant Examiner*—Hung Dang
(74) *Attorney, Agent, or Firm*—Robin Nava; Steve Christian; Brigitte Jeffery

(57) ABSTRACT

A borehole telemetry system including a surface telemetry module, a downhole telemetry module, and a multiplexed datalink between the surface and downhole modules capable of transferring data alternately between an uplink in which date is transferred from the downhole module to the surface module and a downlink in which data is transferred from the surface module to the downhole module; wherein the data link can be switched between a first configuration in which a relatively long time is assigned to the uplink and a relatively short time is assigned to the downlink, and a second configuration in which a relatively long time is assigned to the downlink and a relatively short time is assigned to the uplink. The first configuration can be used to transmit data when logging with downhole tools and the second configuration can be used to program logging tools.

19 Claims, 4 Drawing Sheets

TELEMETRY SYSTEM FOR BOREHOLE LOGGING TOOLS

FIELD OF THE INVENTION

The present invention relates to a telemetry system for use in borehole logging tools. In particular, the invention relates to a system for communicating between a borehole tool when it is located in the borehole and a surface system. The invention also provides a system for communication between different tools connected to the same surface system while in the borehole.

BACKGROUND OF THE INVENTION

In the logging of boreholes, one method of making measurements underground comprises connecting one or more tools to a cable connected to a surface system. The tools are then lowered into the borehole by means of the cable and then drawn back to the surface ("logged") through the borehole while making measurements. The cable, often having multiple conductors (7 conductor "heptacable" is common). The conductors of the cable provide power to the tool from the surface and provide a route for electric signals to be passed between the tool and the surface system. These signals are for example, tool control signals which pass from the surface system to the tool, and tool operation signals and data which pass from the tool to the surface system. A schematic view of a prior art telemetry system is shown in FIG. 1. The system shown comprises a digital telemetry module DTM which is typically located at the surface, a cable C, a downhole telemetry cartridge DTC at the head of a tool string which includes a number of downhole tools T1, T2, . . . each containing a respective interface package IP1, IP2, . . . through which they are in communication with the DTC via a fast tool bus FTB. This system is configured to handle data flows in opposite directions, i.e. from the tools, via the respective IPs and FTB, to the DTC and then to the DTM over the cable ("uplink"), and the reverse direction from the DTM to the DTC and tools over the same path ("downlink") Since the principal object of the system is to provide a communication path from the tools to the surface so that data acquired by the tools in use can be processed and analysed at the surfaces the protocol used favours the uplink at the cost of the downlink to optimise data flow from the tools. The communication path is split into two parts, the cable C and the tool bus FTB, and operation of these two are asynchronous to each other. In the FTB, the uplink and downlink both comprise biphase modulation using a half duplex systems of identical instantaneous data rate and frequency synchronised to a clock in the DTC. The difference between the uplink and the downlink is that the uplink uses CRC error detection with retransmission of detected bad packets while the downlink always sends twice. On the other hand, in the cable C the uplink and downlink systems are quite different. Uplink communication uses quadrature amplitude modulation with T5 and T7 cable modes being used, whereas downlink uses biphase modulation and T5 cable mode only. Both uplink and downlink are half duplex with CRC error detection and retransmission of detected bad packets. The result of this is that the uplink will often have an effective data rate of 500 Kbps compared to an effective downlink rate of 40 Kbps. Thus, when running at 6 Hz, such a system will have a period of 166.7 ms of which approximately 150 ms is allocated to uplink. A suitable protocol for implementing such a system is described in U.S. Pat. Nos. 5,191,326 and 5,331,318, the contents of which are incorporated herein by reference.

Recent developments in downhole tools have resulted in tools including functional components which can be accessed via the tool telemetry system and reprogrammed. An example of this is described in WO 97/28466. While it is possible to effect reprogramming of such a tool using the telemetry system described above, the relatively large amount of data to be transmitted downhole and the relatively low data rate of the downlink mean that the amount of time taken to achieve reprogramming of a single tool is likely to be in the order of hours. This effectively means that downhole reprogramming is impractical and even reprogramming at the surface is a slow and intensive process.

The present invention has the object of providing a telemetry system which maintains the priority given to uplink data flow in logging use, but which can be configured to allow increased downlink data flow when required.

SUMMARY OF THE INVENTION

One aspect of the present invention provides a borehole telemetry system comprising a surface telemetry module, a downhole telemetry module, and a multiplexed datalink between the surface and downhole modules capable of transferring data alternately between an uplink in which date is transferred from the downhole module to the surface module and a downlink in which data is transferred from the surface module to the downhole module; wherein the data link can be switched between a first configuration in which a relatively long time is assigned to the uplink and a relatively short time is assigned to the downlink, and a second configuration in which a relatively long time is assigned to the downlink and a relatively short time is assigned to the uplink.

The modulation of the uplink and the downlink can be the same or different. In a preferred embodiment, the uplink uses quadrature amplitude modulation and the downlink uses biphase modulation. Where a multiconductor cable is used to provide the datalink different modes can be used for uplink and downlink. For example, T5 and T7 modes can be used for uplink and T5 for downlink. Other modes or forms of datalink can be used if appropriate.

The system can effect the change between the configurations by sending a control signal from the surface module to the downhole module.

A system according to the invention finds particular application in borehole logging using a string of downhole tools. In the first configuration, the system is optimised to send data from the downhole tools to the surface, and in the second configuration is optimised to allow programming of the tools in the tool string from the surface telemetry module. A wireline cable is a common form for the datalink between the surface and downhole telemetry modules.

DESCRIPTION OF THE PREFERRED EMBODIMENT

Figure 2A:
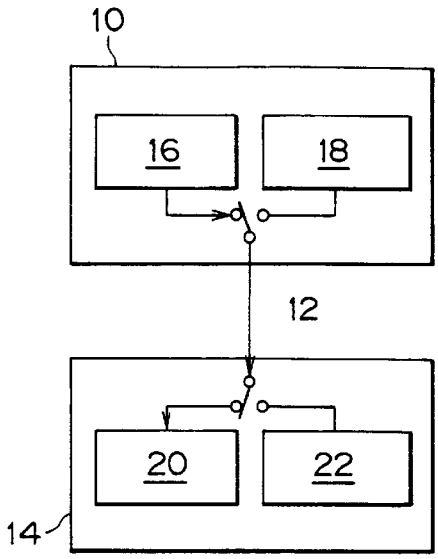
FIGS. 2*a* and 2*b* show schematically the configuration of a telemetry system for downlink and uplink respectively.
Figure 2B:
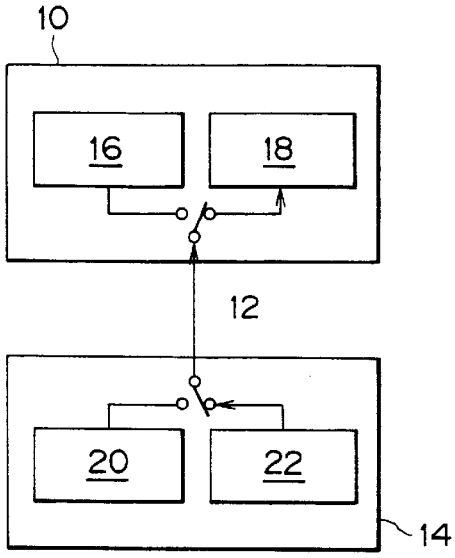

FIGS. 2*a* and 2*b* show schematic diagrams of the two configurations of a telemetry system in accordance with the invention. The basic functional parts of the system comprise a surface telemetry module 10, a cable 12 and a downhole telemetry cartridge 14. The surface telemetry module 10 includes a downlink modulator 16 and an uplink demodulator 18, either of which can be connected to the cable 12. The downhole telemetry cartridge 14 likewise contains a downlink demodulator 20 and an uplink modulator 22, either of which can be connected to the cable 12. In FIG. 2*a*, the system is configured for downlink and so has the downlink modulator 16 and the downlink demodulator 20 connected to the cable 12. In use, signals pass from the surface telemetry module 10, via the modulator 16, cable 12 and demodulator 20 to the downhole telemetry cartridge 14 from which they are passed to the various tools in the tool string (not shown). FIG. 2*b* shows the situation for uplink in which the connections and data flow are reversed.

Figure 3:
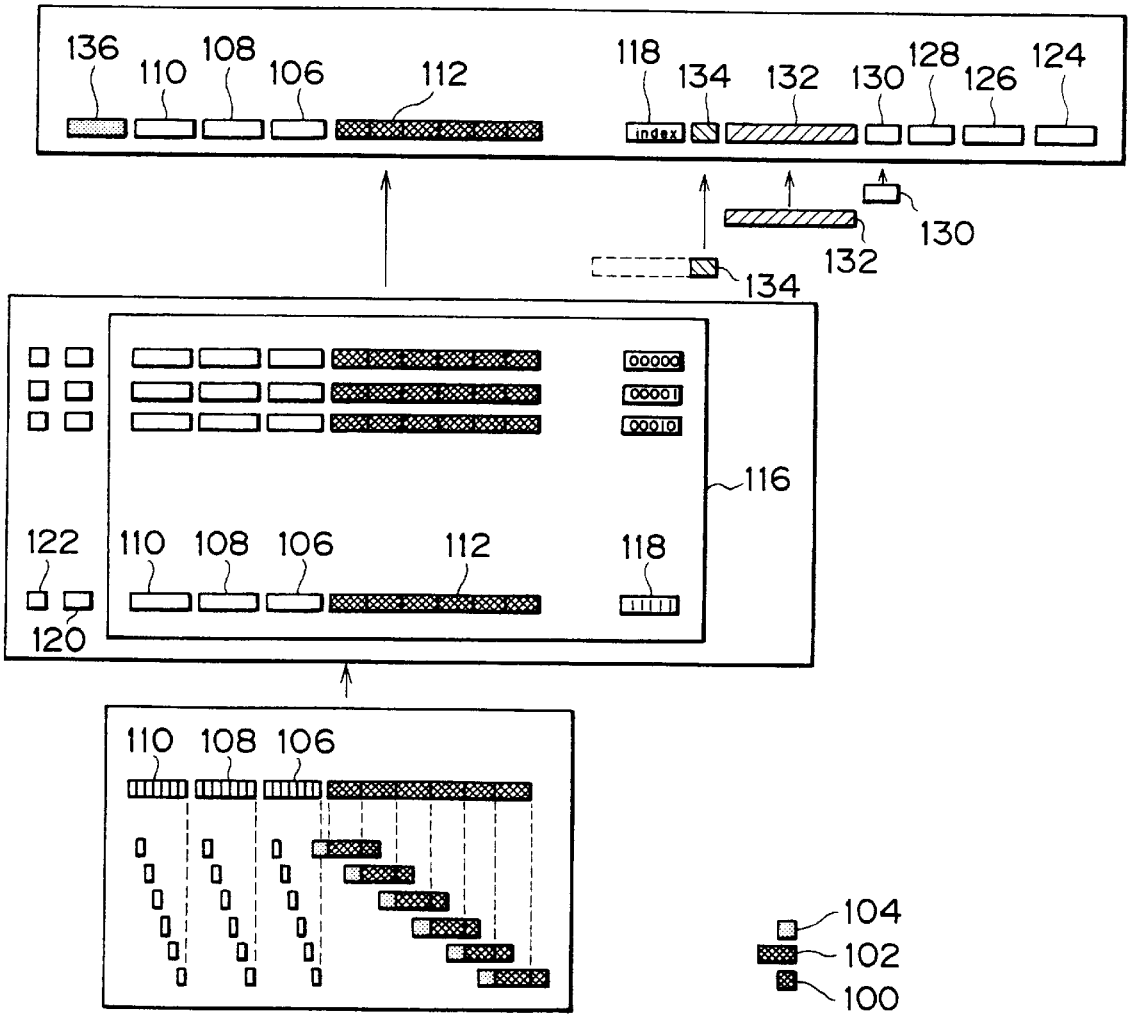
FIG. 3 shows the manner in which data is handled in the DTC for transmission over the cable to the surface.
Figure 4:
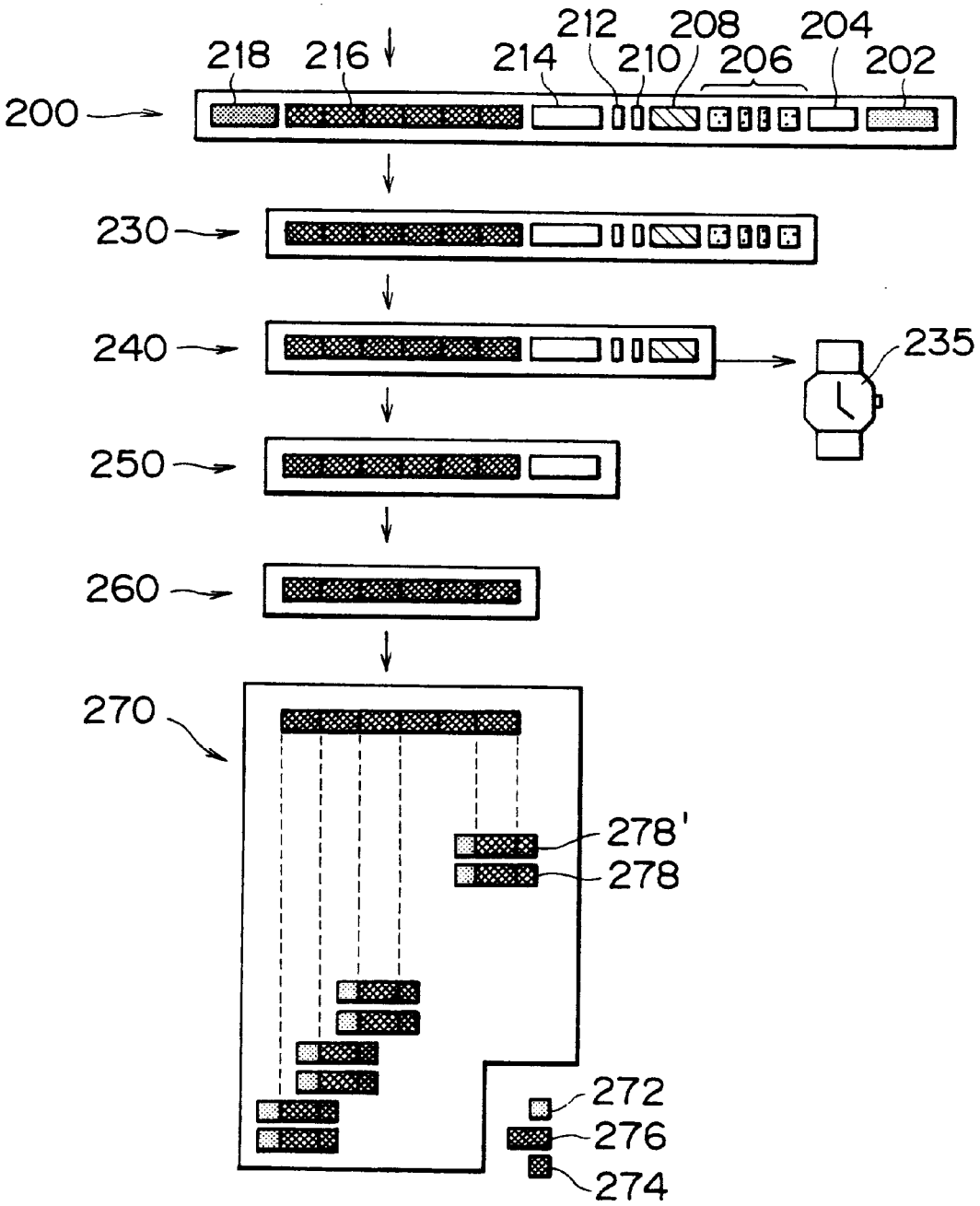
FIG. 4 shows the manner in which data is handled in the DTC received over the cable from the surface for transmission to the tool string.

FIGS. 3 and 4 show schematically the manner in which data is in the uplink and downlink respectively. For the uplink (FIG. 3) the DTC receives a number of packets, each from one FTB frame F and originating with an IP in the tool string (not shown). Each packet comprises a packet sync word 100, a packet core 102 and a CRC (cyclic redundancy check) word 104. The DTC checks the CRC word and any other inconsistency in each packet core 102. Depending on the error (if any), and error bit is set in a packet error word 106, incomplete error word 108 or delay error word 110 (one bit for each packet core). Any packet core with an error is discarded and the status sent uphole and the user notified. An acknowledgement is sent to each IP at the next FTB frame start. If no acknowledgement is sent the IP considers this as a retransmission request for that packet. The DTC strips the CRC 104 and packet sync 100 words from each packet and combines the packet cores 102 to form a superpacket 112 to which a packet error word 106, incomplete error word 108 and delay error word 110 are added. Each superpacket occupies one position in a multi-word buffer 116 in the DTC and is tagged with a superpacket index 118 indicating the position in the buffer 116. Each buffer space is provided with an age pointer 120 to enable the oldest superpacket to be sent first, and an empty/full indicator 122 to indicate if a superpacket has been received without errors or needs to be retransmitted. When the cable uplink frame opens, each superpacket is sent uphole to the DTM one after the other as long as the cable uplink period permits (or until the buffer is empty if this is shorter). To each superpacket is added a series of control words or bits, such as a T5 superpacket sync 124, T7 superpacket sync 126, superpacket length 128, DTC uplink control echo (DTC gains, status and transmit rates) 130, DTC departure time 132, DTC arrival time for the previous cable frame 134, and CRC word 136.

For the downlink (FIG. 4), the DTM sends a downlink string 200, typically comprising a T5 superpacket sync word 202, a superpacket length word 204, DTC uplink control 206, DTC slave clock adjustment 208, training bit 210, sequence bit 212, superpacket acknowledgement 214, N packet cores 216, and CRC word 218. On receipt 230, the sync pulse 202 is stripped off, the CRC computed and any error sent back to the DTM requesting retransmission. The DTC takes note of the arrival time and stores it for transmission back to the DTM on the next uplink transmission for slave clock synchronisation. The DTC uplink controls 206 are applied to the DTC during the next uplink transmission. The DTC slave clock adjustment is used to keep the DTC slave clock 235 synchronised to the DTM's master time clock. The training bit 210 is used to set the DTC training mode and the sequence bit 212 toggles for every downlink sequence to detect missing frames 240. The superpacket acknowledgement 214 confirms the previous uplink, each bit corresponding to one superpacket. Every superpacket indicated as having been received with an error will be retransmitted and every superpacket that is indicated as received without error has its position in the buffer 116 indicated as empty by flag 122 and available for re-use 250. The remaining packet core data 260 waits until the next FTB downlink opens 270, at which point CRC 272 and sync words 274 are added to each packet 276 to create FTB packets 278 each of which is repeated 278' so that the relevant IP can select the best one by checking the CRC. The FTB packets are sent in the order in which they are received by the DTM (first in to DTM, first out of DTC).

Figure 1:
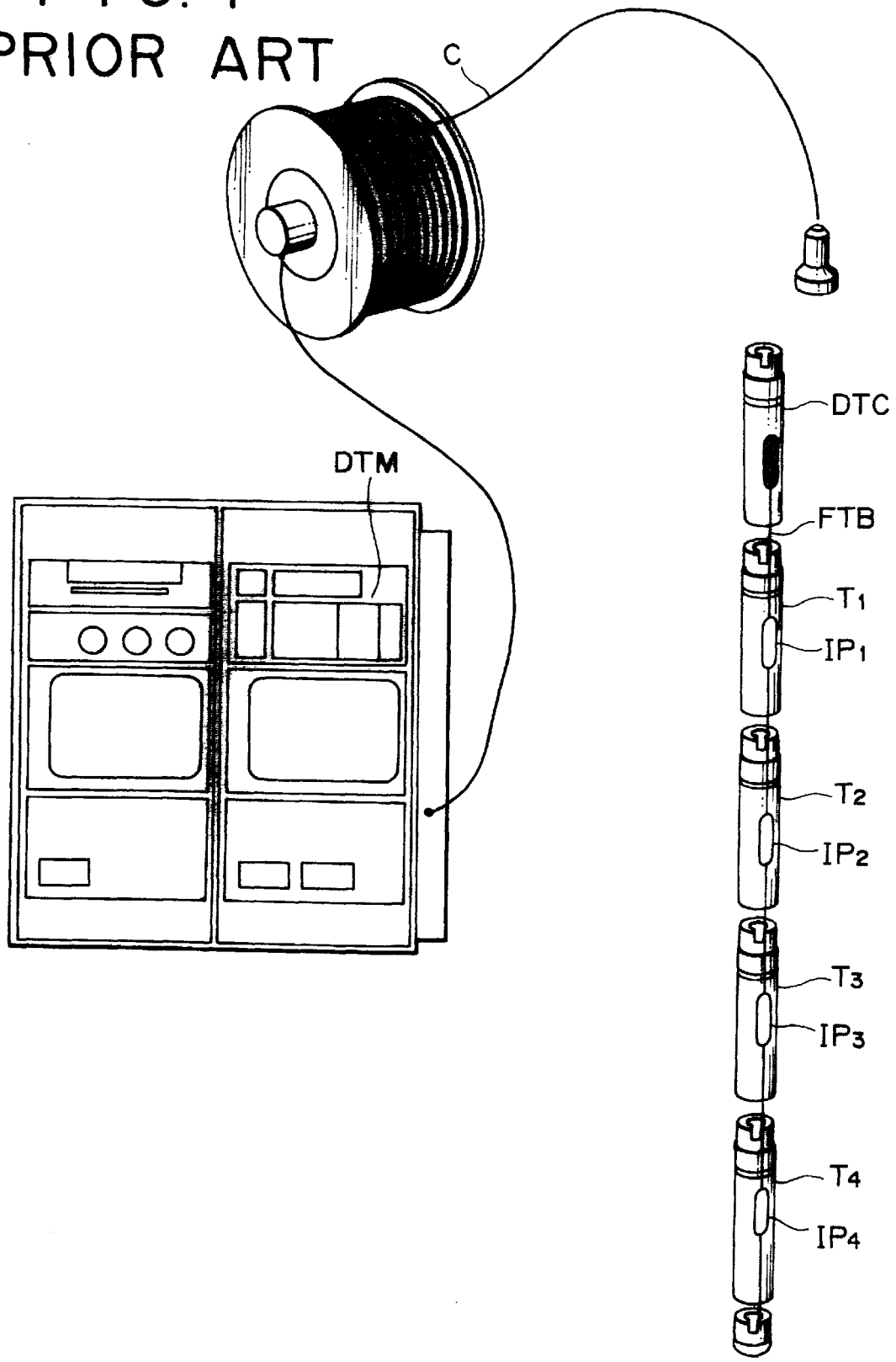
FIG. 1 PRIOR ART
FIG. 1 shows a schematic view of a prior art telemetry system.
Figure 5:
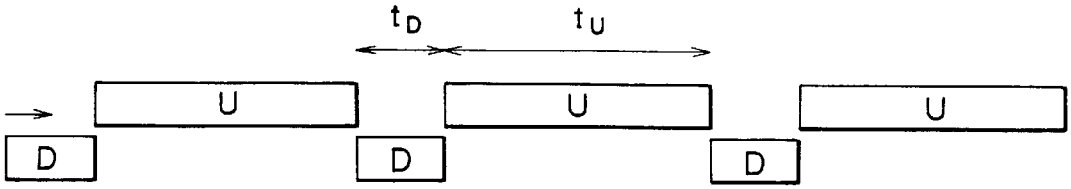
FIG. 5 shows the time allocation to uplink and downlink in the first configuration of the system according to the invention.

FIG. 5 shows the time allocation for uplink $t_U$ and downlink $t_D$ in normal logging operation. For the uplink U, the time is determined by the data rate, the number of superpackets (a typical buffer will contain 32 superpackets) and the size of each superpacket (typically 1024 words to each superpacket, of which a core of up to 1016 words are packet cores and there is one packet core per tool in the string, for example up to 16 tools). As the downlink D only contains one string, the time is dependent on the data rate, the number of packets (typically one per tool in the tool string, therefore typically up to 16), and the number of words per packet (typically up to eight words). This is the manner in which the system of FIG. 1 operates at all times, and in the context of this invention can be considered as the first datalink configuration.

Figure 6:
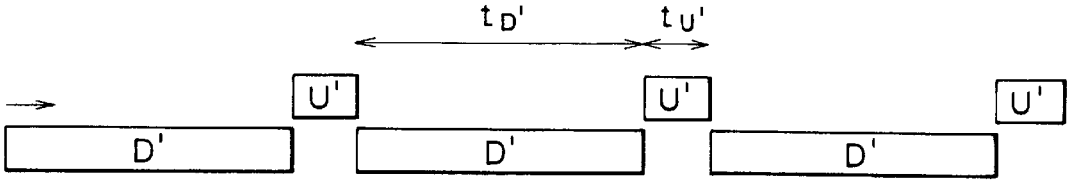
FIG. 6 shows the time allocation to uplink and downlink in the second configuration of the system according to the invention.

For on-board programming activities, the present invention adopts the second datalink configuration as shown in FIG. 6, in which more time $t_{D'}$ is available to downlink D' and less time $t_{U'}$ to uplink U'. This can be achieved in the following manner: First, the number of packet cores and/or the number of words per packet core in each downlink string is increased. Typically the data rate and modulation type used for the downlink will remain the same as in the first configuration to simplify implementation. Second, the size of the superpackets in the uplink is reduced by reducing the size of the packet core data in each superpacket. In one embodiment, each core packet will consist of one word which is merely a confirmation of the receipt of the data from the previous downlink. Thus the size of the superpacket core data could be as small as 16 words in the typical tool string configuration mentioned above and consequently less time will be required to transmit the entire contents of the buffer. Again the data rate and modulation type need not be changed.

The switch between the two configurations requires modification of the control of both the DTM and the DTC. The DTM is under direct software control at the surface. The DTC control can be modified using the DTC uplink control part of the downlink string. Appropriate control words are included to change the superpacket size. Each FTB packet can include instructions for each tool to send only the one word receipt acknowledgement.

By adopting the approach described above, it is possible to arrange for reprogramming of a tool over the normal logging cable in a time which can be measured in minutes rather than hours as is the case with current telemetry systems.

When in the second configuration, the FTB packet differ in that they are longer than in the first configuration and more than one FTB packet can go to a given tool from each downlink string. In this case, each FTB packet will require specific addressing in order to be received by the IP for the tool in question. Clearly it is possible to intersperse periods of the two configurations to allow the tools to alternate between logging and reprogramming.

At the end of the programming, which can be confirmed by appropriate acknowledgement signals, the DTM sends another DTC control to instruct the DTC to resume its original telemetry behaviour (first configuration).

It will be appreciated that other aspects of the system can be changed in order to achieve the second configuration. For example, the number of positions available in the buffer can be reduced during the enhanced downlink configuration. Also, modulation types can be changed to favour one or other configuration. However, this may require significant modification of hardware from current versions of the DTM and DTC.

While the invention has been described in relation to the use of wireline heptacable, it is not restricted to this either for tool conveyance or data communication. The methodology of the invention can be applied to any suitable datalink which has to be optimised for data flow in different directions at different times.

What is claimed is:

1. A borehole telemetry system comprising a surface telemetry module, a downhole telemetry module, and a multiplexed datalink between the surface and downhole modules capable of transferring data alternately between an uplink in which data is transferred from the downhole module to the surface module and a downlink in which data is transferred from the surface module to the downhole module; wherein the datalink can be switched between a first configuration in which a relatively long time is assigned to the uplink and a relatively short time is assigned to the downlink, and a second configuration in which a relatively long time is assigned to the downlink and a relatively short time is assigned to the uplink.

2. A telemetry system as claimed in claim 1, wherein data transfer over the datalink is modulated and modulation of the uplink is different to modulation of the downlink.

3. A telemetry system as claimed in claim 1, wherein the datalink transfers data between the surface and downhole modules via a wireline cable.

4. A telemetry system as claimed in claim 3, wherein the wireline cable also provides power to downhole tools.

5. A telemetry system as claimed in claim 1, wherein the downhole telemetry module is connected to at least one tool for making measurements while in the borehole, the datalink serving to pass data to and from the tool.

6. A telemetry system as claimed in claim 1, wherein the downhole module is instructed to change from the first configuration to the second configuration by means of a signal passed over the datalink from the surface module.

7. A telemetry system as claimed in claim 1, wherein the uplink transfers data as a sequence of superpackets, each superpacket comprising a series of data packet cores together with added control and status words; and the downlink transfers data in a single data string which comprising a series of data packet cores and downhole telemetry module control instructions.

8. A system as claimed in claim 7, wherein in the first configuration, the uplink superpackets include a relatively large number of words and the downlink string has relatively few words compared to the total in the uplink superpacket sequence; and in the second configuration, the uplink superpackets each have relatively few words and the downlink string has a larger number of words.

9. A system as claimed in claim 7, further comprising a downhole tool string including a number of tools, each packet core in the uplink supercore originating with a tool in the tool string.

10. A system as claimed in claim 9, each data packet in the downlink string being passed to a tool in the tool string.

11. A system as claimed in claim 8, wherein to change from the first configuration to the second configuration, a control signal is sent from the surface telemetry module to the downhole telemetry module to instruct the downhole telemetry module to assign fewer words to each superpacket.

12. A system as claimed in claim 8, wherein to change from the second configuration to the first configuration, a control signal is sent from the surface telemetry module to the downhole telemetry module to instruct the downhole telemetry module to assign more words to each superpacket.

13. A system as claimed in claim 10, wherein in the second configuration the data packets in the downlink string are used to program at least one tool in the tool string to change its functionality.

14. A system as claimed in claim 1, wherein the data transfer over the datalink is modulated and the modulation of the uplink is quadrature amplitude modulation.

15. A system as claimed in claim 1, wherein the data transfer over the datalink is modulated and the modulation of the downlink is biphase modulation.

16. A borehole telemetry system comprising a surface telemetry module, a downhole telemetry module and a multiplexed datalink between the surface and downhole modules capable of transferring data alternately between an uplink in which data is transferred from the downhole module to the surface module and a downlink in which data is transferred from between the surface module to the downhole module; wherein the datalink can be switched between a first configuration in which a relatively long time is assigned to the uplink and a relatively short time is assigned to the downlink, and a second configuration in which a relatively long time is assigned to the downlink and a relatively short time is assigned to the uplink, wherein the data transferred in the downlink comprises a data packet comprising a check word.

17. A system as claimed in claim 16, wherein error in the data transferred in the downlink is indicated by said check word.

18. A system as claimed in claim 17, wherein data in the downlink is retransferred from the surface telemetry module.

19. A system as claimed in claim 16, wherein the data transferred in the uplink comprises a data packet comprising a check word.

* * * * *